US009527307B2

(12) United States Patent
Edwards

(10) Patent No.: US 9,527,307 B2
(45) Date of Patent: Dec. 27, 2016

(54) OXYGEN INHIBITION FOR PRINT-HEAD RELIABILITY

(75) Inventor: Paul Edwards, Saline, MI (US)

(73) Assignee: ELECTRONICS FOR IMAGING, INC., Fremont, CA (US)

( * ) Notice: Subject to any disclaimer, the term of this patent is extended or adjusted under 35 U.S.C. 154(b) by 205 days.

(21) Appl. No.: 12/968,748

(22) Filed: Dec. 15, 2010

(65) Prior Publication Data

US 2012/0154495 A1 Jun. 21, 2012

(51) Int. Cl.
*B41J 11/00* (2006.01)

(52) U.S. Cl.
CPC ..... *B41J 11/0015* (2013.01); *B41J 11/002* (2013.01)

(58) Field of Classification Search
CPC ..... B41J 11/0015
USPC ..... 347/102
See application file for complete search history.

(56) References Cited

U.S. PATENT DOCUMENTS

| | | | |
|---|---|---|---|
| 2,927,502 | A | 3/1960 | Watrous |
| 4,326,001 | A | 4/1982 | Sachs et al. |
| 4,857,086 | A | 8/1989 | Kawai |
| 4,952,973 | A | 8/1990 | Jones et al. |
| 5,099,256 | A | 3/1992 | Anderson et al. |
| 5,267,005 | A | 11/1993 | Yamamoto et al. |
| 5,284,506 | A | 2/1994 | Barbe |
| 5,294,946 | A | 3/1994 | Gandy et al. |
| 5,792,296 | A | 8/1998 | Soltysiak |
| 6,126,095 | A | 10/2000 | Matheson et al. |
| 6,154,232 | A | 11/2000 | Hickman et al. |
| 6,335,140 | B1 | 1/2002 | Miyazaki |
| 6,461,064 | B1 | 10/2002 | Leonard et al. |
| 6,522,349 | B1 | 2/2003 | Lee |
| 6,550,905 | B1 | 4/2003 | Deckers |
| 6,550,906 | B2 | 4/2003 | Ylitalo |
| 6,554,414 | B2 | 4/2003 | Ylitalo et al. |
| 6,593,390 | B1 | 7/2003 | Johnson et al. |
| 6,598,531 | B2 | 7/2003 | Nedblake, Jr. et al. |
| 6,683,421 | B1 | 1/2004 | Kennedy et al. |
| 6,736,918 | B1 | 5/2004 | Ichikawa et al. |
| 6,789,873 | B2 | 9/2004 | Booth et al. |
| 6,927,014 | B1 | 8/2005 | Figov |
| 7,278,728 | B2 | 10/2007 | Desie et al. |
| 7,419,716 | B2 | 9/2008 | Tian et al. |
| 7,431,897 | B2 | 10/2008 | Hahne et al. |
| 7,520,601 | B2 | 4/2009 | Claes et al. |
| 8,186,801 | B2 | 5/2012 | Saita et al. |

(Continued)

FOREIGN PATENT DOCUMENTS

| | | | |
|---|---|---|---|
| CN | 1606604 | A | 4/2005 |
| CN | 1817811 | A | 8/2006 |

(Continued)

OTHER PUBLICATIONS

Jack Kenny, UV Curing Technology, Mar. 2009, Label & Narrow Web, retrieved on Oct. 14, 2010 from url: http://www.labelandnarrowweb.com/articles/2009/03/uv-curing-technology; 4 pages.

*Primary Examiner* — Manish S Shah
*Assistant Examiner* — Jeffrey C Morgan
(74) *Attorney, Agent, or Firm* — Michael A. Glenn; Perkins Coie LLP

(57) ABSTRACT

Systems and methods of applying a gaseous inhibitor into a printing region to hinder the curing process of ink on the print heads caused by the presence of stray light in the printing environment.

10 Claims, 6 Drawing Sheets

(56) References Cited

U.S. PATENT DOCUMENTS

| | | | |
|---|---|---|---|
| 2001/0052924 | A1 | 12/2001 | Steinke et al. |
| 2002/0071000 | A1 | 6/2002 | Rezanka et al. |
| 2002/0119395 | A1 | 8/2002 | Kramer et al. |
| 2002/0149659 | A1 | 10/2002 | Wu et al. |
| 2003/0164571 | A1 | 9/2003 | Crump et al. |
| 2003/0227527 | A1 | 12/2003 | Richards et al. |
| 2004/0029030 | A1 | 2/2004 | Murray |
| 2004/0166249 | A1 | 8/2004 | Siegel et al. |
| 2006/0066703 | A1 | 3/2006 | Kadomatsu et al. |
| 2006/0066704 | A1 | 3/2006 | Nishida et al. |
| 2006/0075914 | A1 | 4/2006 | Kawano |
| 2006/0119686 | A1 | 6/2006 | Odell |
| 2006/0158473 | A1 | 7/2006 | Mills et al. |
| 2006/0182937 | A1 | 8/2006 | Tsuchimura |
| 2006/0197787 | A1 | 9/2006 | Kusunoki et al. |
| 2006/0221161 | A1 | 10/2006 | Hori et al. |
| 2007/0013757 | A1 | 1/2007 | Ohnishi |
| 2007/0040885 | A1 | 2/2007 | Kusunoki |
| 2007/0058020 | A1 | 3/2007 | Wetjens et al. |
| 2007/0115335 | A1 | 5/2007 | Vosahlo et al. |
| 2007/0120930 | A1 | 5/2007 | Domoto et al. |
| 2007/0154823 | A1 | 7/2007 | Marson et al. |
| 2007/0171263 | A1 | 7/2007 | Inoue et al. |
| 2007/0184141 | A1 | 8/2007 | Custer et al. |
| 2007/0278422 | A1 | 12/2007 | Einhorn et al. |
| 2007/0296790 | A1 | 12/2007 | Nakazawa et al. |
| 2008/0015278 | A1 | 1/2008 | Malik et al. |
| 2008/0018682 | A1 | 1/2008 | Spehrley et al. |
| 2008/0024548 | A1 | 1/2008 | Shang et al. |
| 2008/0156506 | A1 | 7/2008 | Wagner et al. |
| 2008/0158278 | A1 | 7/2008 | Inoue |
| 2008/0192075 | A1 | 8/2008 | Campion et al. |
| 2008/0192100 | A1 | 8/2008 | Nakajima et al. |
| 2008/0199230 | A1 | 8/2008 | Kawano |
| 2008/0218574 | A1 | 9/2008 | Furuno et al. |
| 2009/0085996 | A1 | 4/2009 | Kasai |
| 2009/0086000 | A1 | 4/2009 | Yokota et al. |
| 2009/0122126 | A1 | 5/2009 | Ray et al. |
| 2009/0207223 | A1* | 8/2009 | Cofler et al. ..... 347/102 |
| 2009/0207224 | A1 | 8/2009 | Cofler |
| 2009/0244165 | A1 | 10/2009 | Saita |
| 2009/0246382 | A1 | 10/2009 | Hirato et al. |
| 2010/0080924 | A1 | 4/2010 | Leng |
| 2010/0177151 | A1 | 7/2010 | Thompson et al. |
| 2010/0208020 | A1 | 8/2010 | Matsumoto |
| 2010/0259589 | A1 | 10/2010 | Barry et al. |
| 2010/0309269 | A1 | 12/2010 | Vosahlo et al. |
| 2011/0122596 | A1 | 5/2011 | Miyazaki et al. |
| 2013/0100216 | A1 | 4/2013 | Ohnishi |

FOREIGN PATENT DOCUMENTS

| | | | |
|---|---|---|---|
| CN | 101291999 | A | 12/2008 |
| EP | 0585160 | A1 | 3/1994 |
| EP | 1484370 | A1 | 12/2004 |
| EP | 1913979 | | 4/2008 |
| GB | 2349607 | A | 11/2000 |
| JP | 62280801 | A | 12/1987 |
| JP | 62280804 | A | 12/1987 |
| JP | 01-265204 | | 10/1989 |
| JP | 01-270002 | | 10/1989 |
| JP | 01-270003 | | 10/1989 |
| JP | 01-279205 | | 11/1989 |
| JP | 07-031831 | | 2/1995 |
| JP | 2000-211244 | | 8/2000 |
| JP | 2004516963 | A | 6/2004 |
| JP | 2004-306589 | | 11/2004 |
| JP | 2006110895 | A | 4/2006 |
| JP | 2008087272 | A | 4/2008 |
| JP | 2008183820 | A | 8/2008 |
| JP | 2009-083267 | | 4/2009 |
| JP | 2010-000742 | | 1/2010 |
| JP | 2010069682 | | 4/2010 |
| JP | 2010241119 | A | 10/2010 |
| JP | 2010269574 | | 12/2010 |
| WO | 02053383 | A2 | 7/2002 |
| WO | WO03103970 | A2 | 12/2003 |
| WO | WO-2008001051 | | 1/2008 |

* cited by examiner

OXYGEN INHIBITION FOR PRINT-HEAD RELIABILITY

BACKGROUND OF THE INVENTION

Technical Field

The invention relates to the field of inkjet printing. More specifically the invention relates to systems and methods of applying a gaseous inhibitor into a printing region to hinder the curing process of ink on the print heads caused by the presence of stray light in the printing environment.

Description of the Related Art

Using electromagnetic radiation to cure liquid chemical formulations has been an established practice for many years. Electromagnetic radiation curing involves a liquid chemical formulation comprising photoinitiators, monomers and oligomers, and possibly pigments and other additives and exposing the formulation to electromagnetic radiation, thereby converting the liquid chemical formulation into a solid state.

In printing applications, radiation-curable ink is jetted from a print head onto a substrate to form a portion of an image. In some applications, the print head scans back and forth across a width of the substrate, while the substrate steps forward for progressive scan passes. In some other applications, one or more blocks of fixed print heads are used to build an image.

In each of these printing settings, curing ink involves directing photons, typically with wavelengths in or near the ultraviolet spectrum, onto an ink deposit. The photons interact with photoinitiators present within the ink, creating free radicals. The created free radicals initiate and propagate polymerization (cure) of the monomers and oligomers within the ink. This chain reaction results in the ink curing into a polymer solid.

However, the use of curable inks has created negative side effects. In particular, standard ink curing designs have issues with the print heads being exposed to stray light and with ink hardening onto the print heads due to the exposure. Stray light enters the printing environment in a variety of ways. For example, environmental light enters even the smallest openings and reflects throughout the system. Additionally, printing systems are oftentimes opened to environmental light to access printer components. Furthermore, printing systems sometimes produce their own light by way of scanner functions or curing lamps.

Exposure to any stray light encourages ink to harden onto print heads. The hardened ink subsequently deflects the spray from the print head and causes poor print quality. Indeed, even a very small deflection in ink spray can cause ruinous results.

In all types of printers which use light-curing (i.e. wide-format, super wide format, single pass, etc.), similar methodologies have been applied to limit the impact of stray or ambient light. Some workarounds include the use of physical shutters and baffles to deflect the light coming from the lamps. However, no matter how much shielding is used, stray light still enters the printer. Another attempted solution involves configuring a curing lamp at such an angle that the light cannot deflect back at the print-heads. However, this technique detracts from the lamp's effectiveness in curing. Another attempted approach involved configuring a shield around the print zone that stops ambient light, especially UV, from entering the printer and reaching the heads. However, as explained above, stray light still enters the printer.

A number of other factors exacerbate the problems associated with stray light. Firstly, there are issues with inks curing on heads where the substrates being printed are very reflective, such as metallic finish substrates and even glossy white substrates. In these cases the amount of reflected light is much higher than usual. Secondly, with the increase in cure speed of the printers, both the ink sensitivity to UV light and the amount of light applied have increased substantially, thereby causing increased risk of ink curing on the heads. Thirdly, there are instances in printer design, where there is insufficient room to effectively shield the heads from stray light from the source.

Moreover, light emitting diodes (LEDs) are now predominately used for ink curing. The LEDS used operate at wavelengths in the upper band of the visible spectrum and into the ultraviolet spectrum and the ink is designed to be cured at these wavelengths. Accordingly, environmental light is particularly troublesome since environmental light contains a lot of energy in that band.

Yet another complication to the problem of stray light arises from the practice of using gaseous nitrogen in a print system to supplant oxygen. The presence of oxygen at the ink surface inhibits the curing reaction from occurring within the ink. This is often referred to as oxygen inhibition. Accordingly, the practice of supplanting oxygen in a curing region increases the efficiency of the cure process. However, nitrogen curing results in escaped nitrogen exposed to the print region, thereby exacerbating the problem of ink becoming cured to the printer heads.

SUMMARY OF THE INVENTION

In view of the foregoing the invention provides systems and methods of applying a gaseous inhibitor into a printing region to hinder the curing process of ink on the print heads caused by the presence of stray light in the printing environment.

Some embodiments of the invention involve single-layer and multi-layer single-pass printing systems involving oxygen applicators for supplying a blanket of oxygen to a substrate entering a printing region. Likewise, some embodiments of the invention involve a method of oxygen inhibition in single-layer and multi-layer printing systems.

Some embodiments of the invention involve a multi-pass scanning printing system having a carriage with a plurality of oxygen applicators, a plurality of curing lamps, a plurality of nitrogen applicators, and a hardware controller for selectively activating and deactivating the various applicators as the carriage sweeps back and forth across the substrate.

Some embodiments of the invention involve a method for selectively activating and deactivating various nitrogen and oxygen applicators as a print carriage sweeps back and forth across the substrate in a multi-pass scanning printing system.

DETAILED DESCRIPTION OF THE INVENTION

The invention solves the problem of inks curing on print-heads and nozzles in printing systems due to the effects of stray light from a curing lamp or from the outside environment by introducing curing inhibition zones around the print heads where curing effectively becomes much more difficult to occur. In the presently preferred embodiments of the invention, the inhibition zones comprise an application of oxygen to a print head region, thereby reducing the ability for ink to cure on the heads due to oxygen's inhibition effect on the free radical cure process.

Figure 1A:
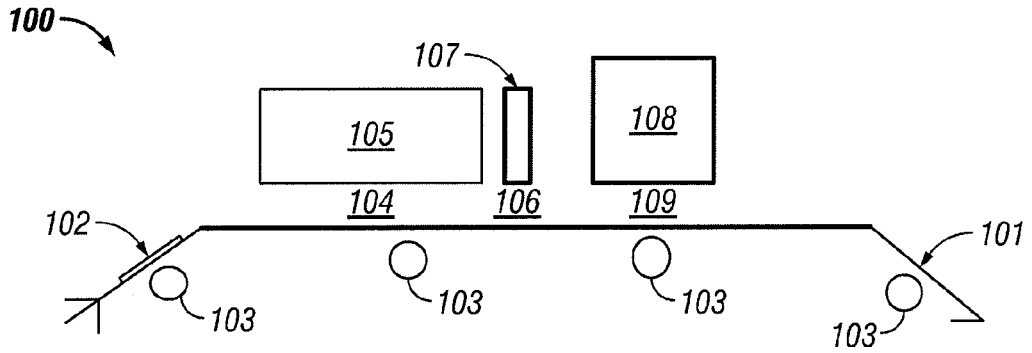
FIG. 1A (Prior Art)
FIG. 1A illustrates a prior art single-pass printing system involving the application of nitrogen in a process of ultraviolet (UV) curing

FIG. 1A illustrates a prior art single-pass printing system 100 involving the application of nitrogen in a process of ultraviolet (UV) curing. According to FIG. 1A, a transport surface 101 is directed over a series of rollers 103 and is configured to move a substrate 102 through the printing system 100.

The substrate 102 is first transported through a printing region 104 beneath a block of print heads 105 configured for applying ink to the substrate 102. According to FIG. 1A, the block of print heads 105 applies UV curable ink. Once the substrate 102 is exposed to the application of ink, it is subsequently passed through an inerting zone 106 comprising a region exposed to a blanket of nitrogen applied via a nitrogen applicator 107. Environmental air contains about 20% oxygen and 78% nitrogen. Accordingly, the blanket of nitrogen replaces environmental air with a less reactive nitrogen gas composition—usually 95% up to 99.9% pure nitrogen. Oxygen is a natural inhibitor of free radical cure and the removal of the oxygen significantly increases the rate of cure at the surface of the ink.

Finally, the printed and inerted substrate is transported into a curing region 109 where the ink is exposed to light from a curing lamp 108, thereby curing the ink.

Although the inertinq zone 106 is located after the printing region 104 in the transport process, a portion of the nitrogen disperses to the printing region 104. As explained above, stray light enters the printing environment in a variety of ways and exposure to any stray light encourages ink to harden onto print heads. Therefore, the presence of nitrogen in the printing region 104 significantly increases the rate of cure of ink on the print heads.

Figure 1B:
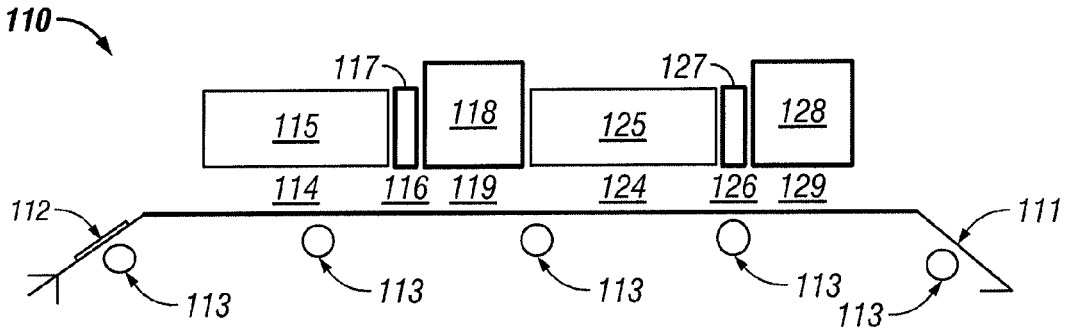
FIG. 1B (Prior Art)
FIG. 1B illustrates a prior art single-pass, multi-layer inkjet printing apparatus configured to deposit two layers of ink on a substrate.

The problem associated with the presence of nitrogen in a printing region is exacerbated in multilayer printing system. There are many instances where multilayer printing is advantageous. For example, two-sided images are printed on a transparent substrate using an intermediate white layer. FIG. 1B illustrates a prior art single-pass, multi-layer inkjet printing apparatus 110 configured to deposit two layers of ink on a substrate 112.

According to FIG. 1B, a transport surface 111 is directed over a series of rollers 113 and is configured to move a substrate 112 through the printing system 110.

The substrate 112 is transported through a first printing region 114 beneath a first block of print heads 115 configured for applying ink to the substrate 112. After the substrate 112 is exposed to the application of ink, it is subsequently passed through an inerting zone 116 comprising a region exposed to a blanket of nitrogen applied via a nitrogen applicator 117. Next, the printed and inerted substrate 112 is transported into a first curing region 119 where the ink is exposed to light from a first curing lamp 118, thereby curing a first layer of ink.

The substrate 112 is then transported through a second printing region 124 beneath a second block of print heads 125 configured for applying ink to the substrate 112. After the substrate 112 is exposed to a second application of ink, it is subsequently passed through a second inerting zone 126 comprising a region exposed to a blanket of nitrogen applied via a second nitrogen applicator 127. Finally, the substrate 112 is transported into a second curing region 129 where the ink is exposed to light from a second curing lamp 128, thereby curing a second layer of ink.

As previously mentioned, the problem associated with the presence of nitrogen in a printing region is exacerbated in a multilayer printing system like the one illustrated in FIG. 1B. This is due to the introduction of even more nitrogen into the second printing region 124 in addition to dispersed nitrogen. As the substrate 112 is transported through the stations, nitrogen gas from the inerting zones is "pulled" along with the substrate 112. Therefore, the substrate 112 delivers nitrogen gas to the second printing region 124. This excess nitrogen gas significantly increases the rate of cure of ink on the print heads due to stray light.

The presently preferred embodiments of the invention address the problems associated with the prior art solutions through oxygen inhibition in the printing regions.

Figure 2A:
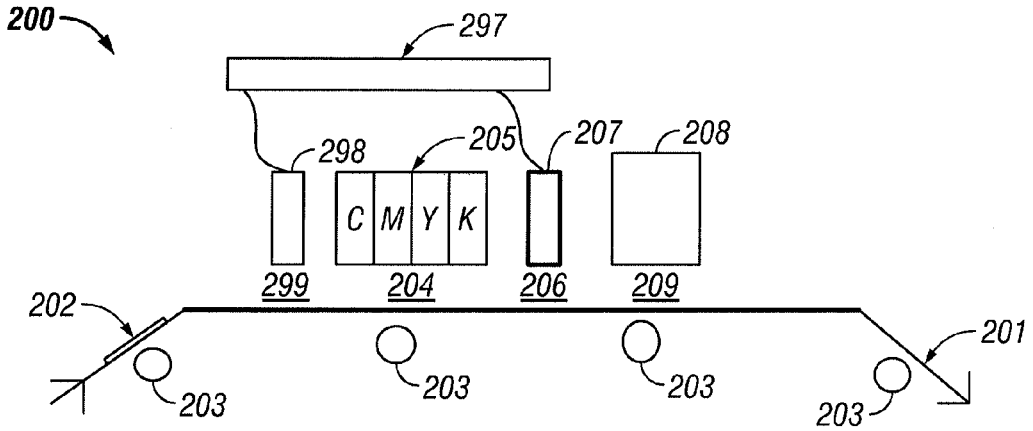
FIG. 2A illustrates a single-pass printing system involving oxygen inhibition according to some embodiments of the invention.

FIG. 2A illustrates a single-pass printing system 200 involving oxygen inhibition according to some embodiments of the invention. According to FIG. 2A, a transport surface 201 is directed over a series of rollers 203 and is configured to move a substrate 202 through the printing system 200.

According to FIG. 2A, the substrate 202 is first transported through an oxygen inhibition region 299 in which a blanket of oxygen is deposited via an oxygen applicator 298. This technique of oxygen inhibition protects the printheads from having ink cure on them due to stray or ambient light due to the fact that the oxygen rich feed is applied just before the heads and the motion of a substrate helps to create a blanket across the heads. In other words, the blanket of oxygen rich air is dragged along with the substrate and remains present near the print-heads while the printer is in operation.

The transport surface 201 moves the substrate 202 into the printing region 204 beneath a block of print heads 205 configured for applying ink to the substrate 202.

As shown in FIG. 2A, the printing block 205 includes print heads defining the CMYK color model. However, it will be readily apparent to those with ordinary skill in the art having the benefit of the disclosure that other color models, now known or later developed, are equally applicable to accomplish the invention, as disclosed broadly herein.

In the presently preferred embodiments of the invention, the block of print heads 205 applies UV curable ink which is subsequently cured in a curing region 209 by a UV curing lamp 208. However, the oxygen blanket must be deflected before it reaches the cure station 209, otherwise the oxygen will inhibit cure of the print, as explained above. Therefore, once the substrate 202 is exposed to the application of ink, it is subsequently passed through an inerting zone 206 comprising an inerting region 206 exposed to a blanket of nitrogen applied via a nitrogen applicator 207. In some other embodiments, the evacuation of oxygen is accomplished using baffles.

Finally, the printed and inerted substrate is transported into a curing region 209 where the ink is exposed to light from a curing lamp 208, thereby curing the ink.

In some embodiments of the invention, the nitrogen gas supplied to the nitrogen applicator 207 and the oxygen supplied to the oxygen applicator 298 are delivered via separate nitrogen and air sources.

In the presently preferred embodiments of the invention, a membrane-based nitrogen generator 297 is used to supply the nitrogen gas and the oxygen gas. Indeed, eliminating separate nitrogen or oxygen tanks obviates the need for consumable nitrogen or oxygen tanks that constantly require replacement and that can be expensive. Furthermore, the elimination of tanks further reduces the footprint of the system.

In some embodiments of the invention, an adsorption gas separation process is used to generate nitrogen. In some other embodiments, a gas separation membrane is used to generate nitrogen. According to the embodiments in which a membrane is used, a compressed air source delivers air that is first cleaned to remove oil vapor or water vapor. The clean, compressed air is then driven through a series of membranes to separate oxygen out of the air, resulting in a gas having higher levels of nitrogen.

In some embodiments of the invention, the purity of the oxygen stream into the oxygen applicator 298 ranges between 40% and 60%. In some other embodiments of the invention, the purity of the oxygen stream into the oxygen applicator 298 ranges between 60% and 80%.

In the presently preferred embodiments of the invention, the purity of the oxygen stream into the oxygen applicator 298 is greater than 80%. In some embodiments of the invention, a static elimination device is strategically positioned in the printing system 200 to avoid creation of ignition points, such as sparks in the oxygen rich atmosphere.

Also, in the presently-preferred embodiments of the invention, the curing lamp 208 comprises light-emitting diodes (LEDs). However, it will be readily apparent to those with ordinary skill in the art having the benefit of the disclosure that other types of lighting technology, such as incandescent lamps and fluorescent lamps, are equally applicable.

Figure 2B:
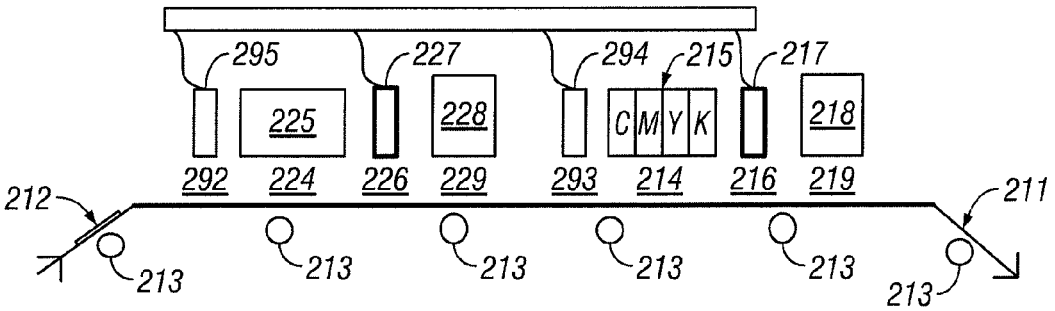
FIG. 2B illustrates a single-pass, multi-layer inkjet printing apparatus with multiple oxygen inhibition regions according to some embodiments of the invention.

The problems associated with the presence of nitrogen in a printing region in a multilayer printing system explain in relation to FIG. 1B are eliminated in a printing system 220 according to FIG. 2B.

FIG. 2B illustrates a single-pass, multi-layer inkjet printing apparatus 210 with multiple oxygen inhibition regions according to some embodiments of the invention.

According to FIG. 2B, a transport surface 211 is directed over a series of rollers 213 and is configured to move a substrate 212 through the printing system 210.

The substrate 212 is first applied with a blanket of oxygen from an oxygen applicator 295 when the substrate 212 is passed into a first oxygen inhibition region 292. The substrate 212 is then transported through a first printing region 224 beneath a first block of print heads 225 configured for applying ink to the substrate 212. In some cases for printing two-sided images on a transparent substrate, the first block of print heads 225 is configured to apply white, or otherwise opaque, ink onto the transparent substrate.

After the substrate 212 is exposed to the application of ink, it is subsequently passed through a first inerting zone 226 comprising a region exposed to a blanket of nitrogen applied via a nitrogen applicator 227. Next, the printed and inerted substrate 212 is transported into a first curing region 229 where the ink is exposed to light from a first curing lamp 228, thereby curing a first layer of ink.

The substrate 212 is applied with a second blanket of oxygen from a second oxygen applicator 294 when the substrate is passed into a second oxygen inhibition region 293. The substrate 212 is then transported through a second printing region 214 beneath a second block of print heads 215 configured for applying ink to the substrate 112. In the case of printing two-sided images, the second block of print heads 215 is preferably the color print heads.

After the substrate 212 is exposed to a second application of ink, it is subsequently passed through a second inerting zone 216 comprising a region exposed to a blanket of nitrogen applied via a second nitrogen applicator 217. Finally, the substrate 212 is transported into a second curing region 219 where the ink is exposed to light from a second curing lamp 218, thereby curing a second layer of ink.

Figure 2C:
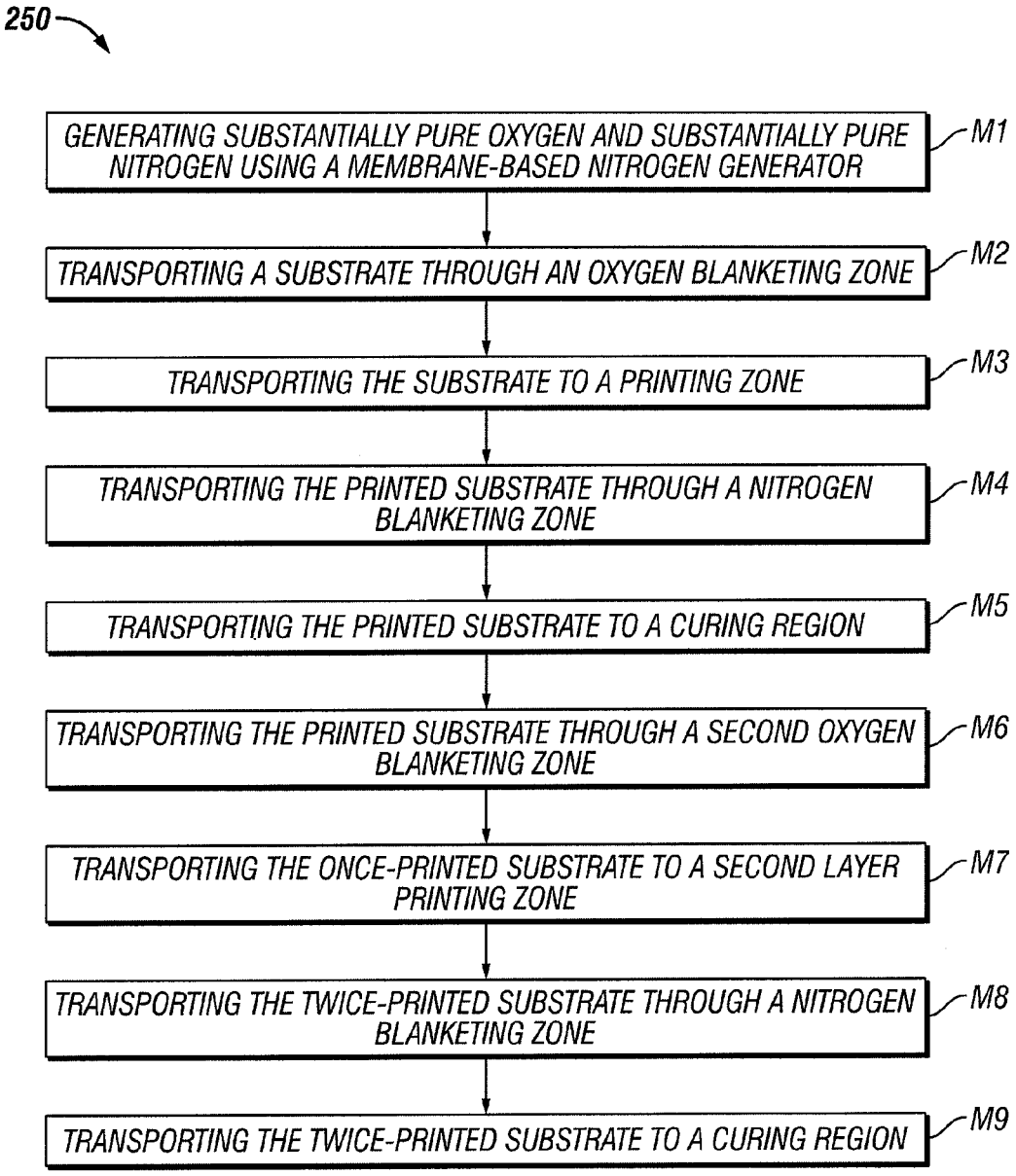
FIG. 2C illustrates a method of oxygen inhibition in a multi-layer printing system according to some embodiments of the invention.

FIG. 2C illustrates a method of oxygen inhibition 250 in a multi-layer printing system according to some embodiments of the invention. In the presently preferred embodiments of the invention, the method 250 begins with generating substantially pure oxygen and substantially pure nitrogen at step M1 using a membrane-based nitrogen generator.

The method 250 continues with transporting a substrate through an oxygen blanketing zone at step M2. The substrate is then transported to a printing zone at step M3 wherein ink is applied to the substrate in an oxygen rich atmosphere. Next, the substrate is transported through a nitrogen blanketing zone at step M4 wherein the oxygen and other gases are supplanted by a blanket of nitrogen. The substrate is then transported to a curing region at step M5 wherein the ink is illuminated with ultraviolet light in a nitrogen rich atmosphere.

The method 250 continues with transporting the printed substrate through a second oxygen blanketing zone at step M6. The printed substrate is then transported to a second layer printing zone at step M7 wherein a second layer of ink is applied to the printed substrate in an oxygen rich atmosphere. Next, the twice-printed substrate is transported through a nitrogen blanketing zone at step M8 wherein the oxygen and other gases are supplanted by a blanket of nitrogen. The twice-printed substrate is then transported to a curing region at step M9 wherein the ink is illuminated with ultraviolet light in a nitrogen rich atmosphere.

The benefits of using oxygen inhibition in relation to the single-pass printing systems described above are also relevant to multi-pass, or scanning, printing systems.

Figure 3A:
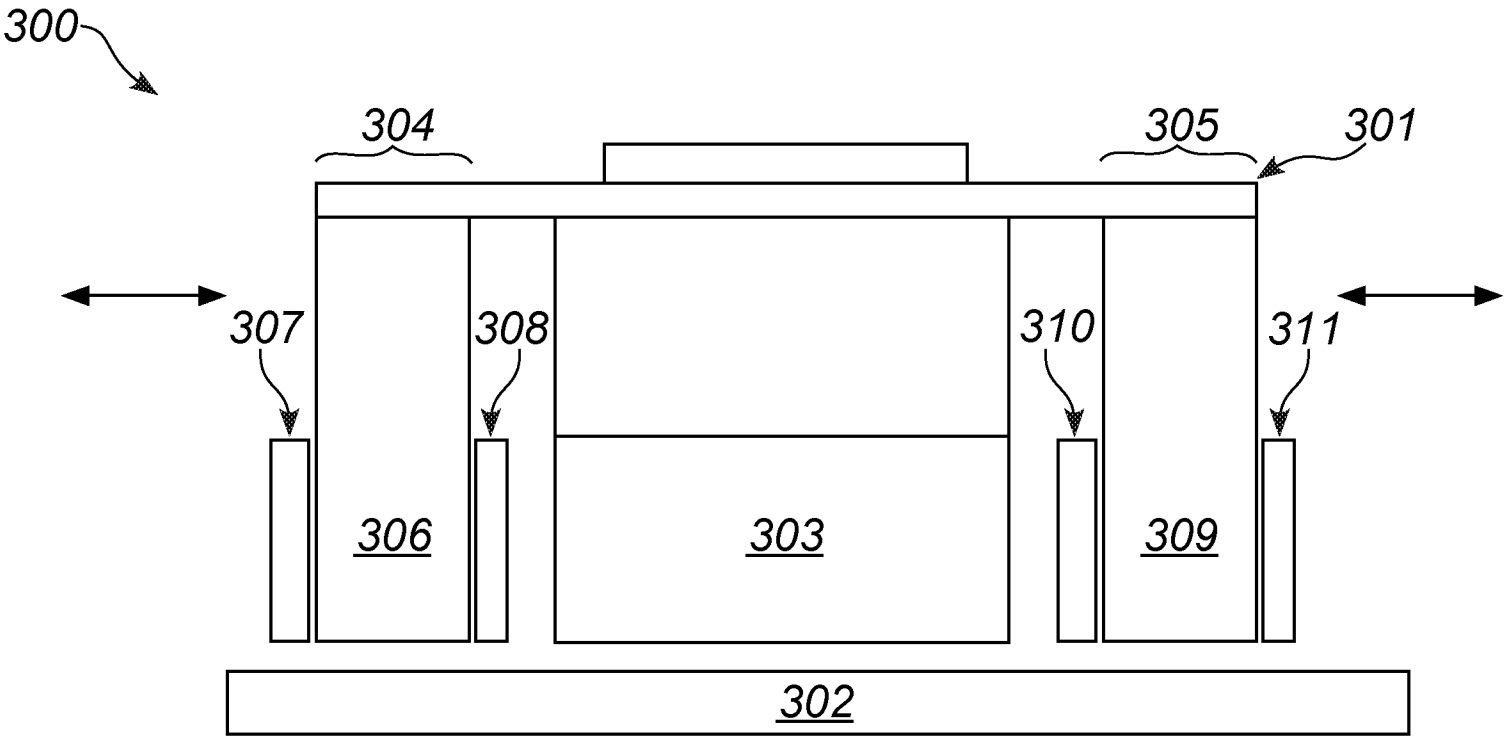
FIG. 3A illustrates a prior art multi-pass scanning printing system configured to deposit ink onto a substrate.

FIG. 3A illustrates a prior art multi-pass scanning printing system 300 configured to deposit ink onto a substrate 302. According to FIG. 3A, a print carriage 301 moves back and forth across a substrate 302 (as indicated by the arrows) as the substrate 302 steps forward under the print carriage 301 (into the page). The carriage 301 includes a printing block 303 with print heads configured for applying liquid ink to the substrate 302. The carriage 301 also includes two curing stations 304, 305 positioned on either side of the printing block 303. Curing station 304 comprises a curing lamp 306 and two nitrogen applicators 307, 308. Likewise, curing station 305 comprises a curing lamp 309 and two nitrogen applicators 310, 311.

The printing system 300 of FIG. 3A is a multi-pass printing system characterized by the fact that the printing block 303 applies ink to the same spot on the substrate 302 at least two times. Accordingly, as the print carriage 301 moves back and forth, the printing block 303 applies ink to the substrate 302 and the curing lamp (306 or 309) of the trailing curing station (304 or 305) partially cures the deposited ink. In the return traversal, the curing lamp (306 or 309) of the leading curing station (304 or 305) fully cures the previously partially-cured ink before the printing block 303 applies another deposit of ink.

The nitrogen applicators (307, 308, 310, and 311) are somewhat directional in that the gas they emit is blanketed in a trailing fashion. Therefore, the leading curing station (304 or 305) deposits nitrogen gas directly to an area where the print heads of the printing block 303 will be moments after its deposit, thereby encouraging the curing of ink to the print heads.

Therefore, some embodiments of the invention involve oxygen applicators in a multi-pass, scanning printing system, thereby inhibiting the curing of ink on the print heads.

Figure 3B:
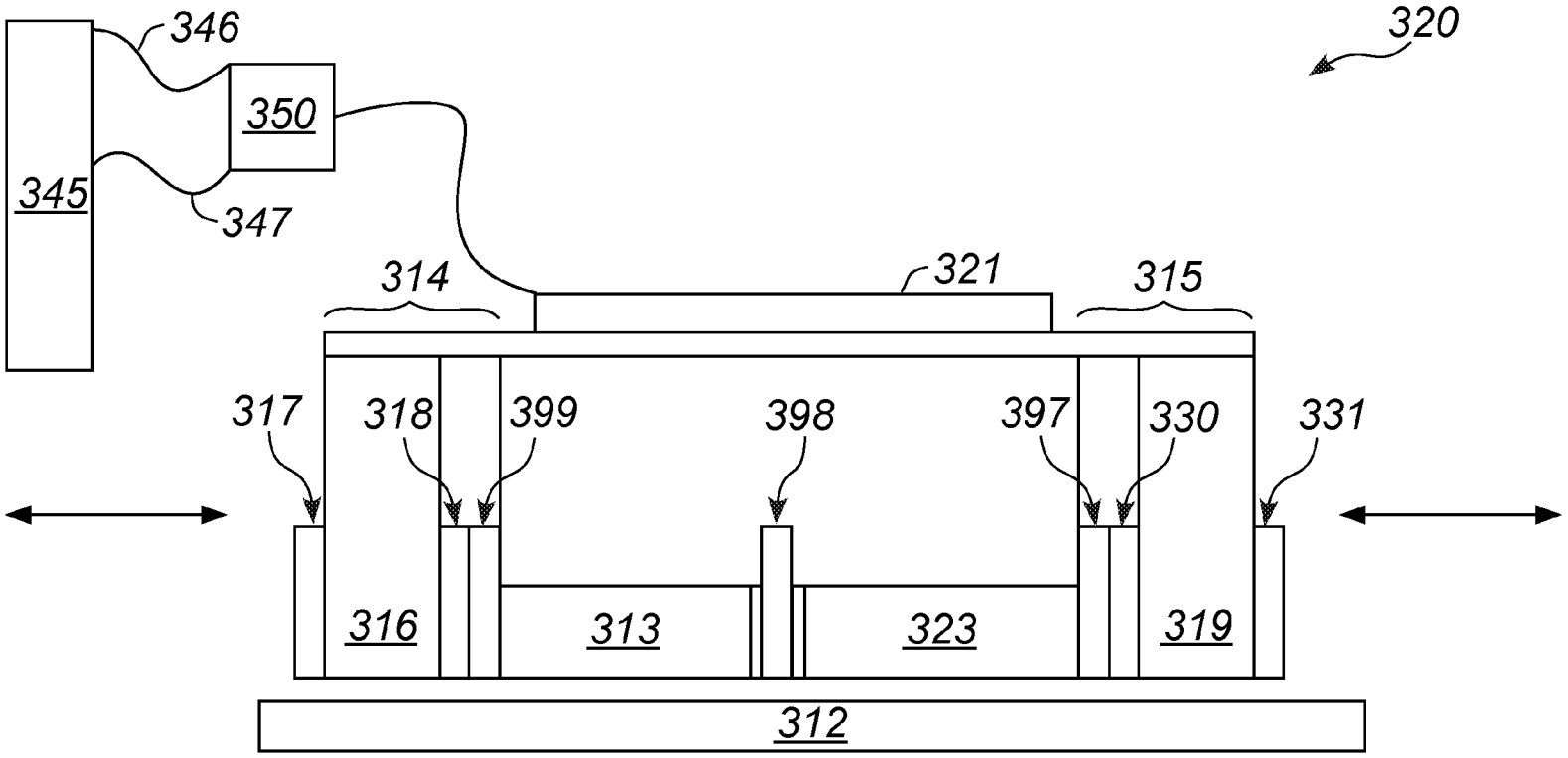
FIG. 3B illustrates a multi-pass scanning printing system with a plurality of oxygen applicators according to some embodiments of the invention.

FIG. 3B illustrates a multi-pass scanning printing system 320 with a plurality of oxygen applicators 399, 398, 397 according to some embodiments of the invention.

According to FIG. 3B, a print carriage 321 moves back and forth across a substrate 312 (as indicated by the arrows) as the substrate 312 steps forward under the print carriage 321 (into the page). The print carriage 321 includes a plurality of printing blocks 313, 323 with print heads configured for applying liquid ink to the substrate 312.

The printing system 320 of FIG. 3B is a multi-pass printing system characterized by the fact that the printing blocks 313, 323 apply ink to the same spot on the substrate 312 at least two times.

The print carriage 321 also includes two curing stations 314, 315 positioned on either side of the print carriage 321. Curing station 314 comprises a curing lamp 316, two nitrogen applicators 317, 318, and an oxygen applicator 399. Likewise, curing station 315 comprises a curing lamp 319, two nitrogen applicators 330, 331, and another oxygen applicator 397. A third oxygen applicator 398 is positioned between the two printing blocks 313, 323.

As the print carriage 321 moves back and forth, the printing blocks 313, 323 apply ink to the substrate 312, and the curing lamp (316 or 319) of the trailing curing station (314 or 315) partially cures the deposited ink. In the return traversal, the curing lamp (316 or 319) of the leading curing station (314 or 315) fully cures the previously partially-cured ink before the printing block (313 or 323) applies another deposit of ink.

The nitrogen applicators (317, 318, 330, and 331) and the oxygen applicators (399, 398, and 397) are somewhat directional in that the gas they emit is blanketed in a trailing fashion. Therefore, the leading curing station (314 or 315) deposits nitrogen gas directly to an area where the print heads of the printing block (313 or 323) will be moments after its deposit.

The printing system 310 of FIG. 3B also includes a controller 350 configured to selectively activate and deactivate the nitrogen applicators 317, 318, 330, and 331 and the oxygen applicators 399, 398, and 397 in such a way as to apply a steady blanket of oxygen around printing blocks 313, 323, thereby hindering ink curing on the print heads, while simultaneously applying a blanket of nitrogen in the curing regions, thereby ensuring a good cure.

In the presently preferred embodiment of the invention, the controller 350 is coupled with a membrane-based nitrogen generator 345 used to supply the nitrogen gas via supply tube 346 and the oxygen gas via supply tube 347. Also in the presently preferred embodiments, the controller 350 comprises a processor (not shown) configured to selectively open and close a plurality of valves (not shown) for selectively allowing nitrogen flow from the nitrogen supply tube 346 to the nitrogen applicators 317, 318, 330, and 331 and for selectively allowing oxygen flow from the oxygen supply tube 347 to the oxygen applicators 399, 398, and 397. The selective allowance of nitrogen gas and oxygen gas is described in detail below.

Figure 4:
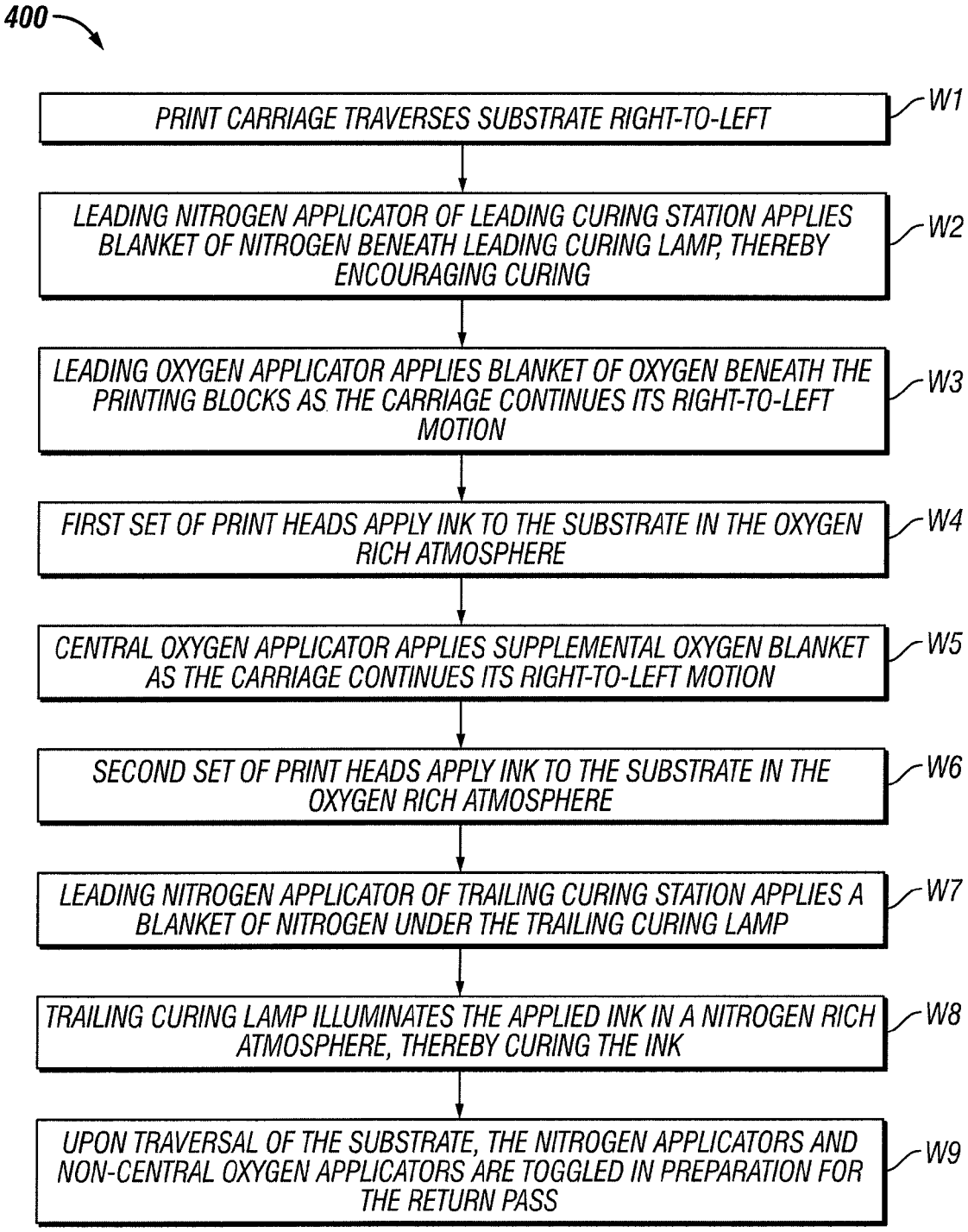
FIG. 4 illustrates a workflow for the multi-pass scanning print system described in FIG. 3B according to some embodiments of the invention.

FIG. 4 illustrates a workflow 400 for the multi-pass scanning print system described in FIG. 3B according to some embodiments of the invention. Accordingly, the same reference numerals are used in FIG. 4 as in FIG. 3B to describe the workflow 400.

The workflow 400 describes a multi-pass printing process that is mid-operational—in that the printing blocks 313, 323 have already applied at least a first application of ink to the substrate 312. For the purpose of FIG. 4, suppose that the print carriage 321 starts on the right hand side of the substrate 312 and moves toward the left hand side at step W1.

At step W2, the print carriage 321 moves right-to-left, nitrogen applicator 20 317 is active such that nitrogen passes beneath curing lamp 316, thereby encouraging curing of ink previously printed and partially cured in a previous pass.

Next, at step W3, the leading oxygen applicator 399 is activated such that a blanket of oxygen supplants the nitrogen and passes beneath the printing block 313 as the print carriage 321 continues its right-to-left motion. Accordingly, the blanket of oxygen protects the print heads of printing block 313, as the print heads apply ink to the substrate 312 in the oxygen rich atmosphere at step W4.

In some embodiments of the invention, the printing blocks 313, 323 have a large profile such that the blanket of oxygen diffuses during the time the printing blocks move over a point on the substrate 312. In these embodiments, a central oxygen applicator 398 is configured between the printing blocks 313, 323. Preferably, the central oxygen applicator 398 is active at all time during the workflow 400. Accordingly, the central oxygen applicator 398 applies supplemental oxygen to the printing area at step W5 after the leading printing block 313 passes over the area. Next, at step W6, the trailing printing block 323 applies ink to the substrate 312 in the oxygen rich atmosphere.

After the application of ink from printing blocks 313 and 323, the workflow 400 continues as the trailing curing station 315 passes over the area of the substrate 312 recently printed on. At step W7, the leading oxygen application 397 remains inactive and the leading nitrogen applicator 330 is activated, thereby providing a blanket of nitrogen under the curing lamp 319. At step W8, the curing lamp 319 illuminates the applied ink in a nitrogen rich atmosphere, thereby curing the ink.

Once the print carriage 321 reaches its left-most point in its traversal of the substrate 312, the nitrogen applicators 317, 318, 330, 331 and oxygen applicators 399 and 397 are toggled at step W9 in preparation for the return pass. In some embodiments of the invention, the applicators are switched from active to inactive using a central valve control. However, it will be apparent to those having ordinary skill in the art that a variety of control mechanisms are equally applicable.

More specifically, at step W9, when the print carriage 321 travels left-to-right, the nitrogen applicator 331 is switched on and nitrogen applicator 317 is switched off; the nitrogen applicator 330 is switched off to keep nitrogen away from print heads; the oxygen applicator 397 is switched on to apply a blanket of oxygen for the printing blocks 323, 313; the nitrogen applicator 318 is turned on to provide a nitrogen blanket under the curing lamp 316; and the oxygen applicator 399 is switched off.

In some embodiments of the invention the curing lamps 316 and 319 are standard Ultraviolet lamps. According to these embodiments, both curing lamps 316 and 319 remain active during the workflow 400. In some other embodiments, the curing lamps 316 and 319 are Light Emitting Diode (LED) lamps. According to these embodiments, the LED curing lamps 316 and 319 are turned on and off when not positioned over uncured ink, thereby reducing system light.

According to the workflow 400 of FIG. 4, a blanket of oxygen remains present in the printing regions while a blanket of nitrogen remains present in the curing regions, thereby optimizing the printing process and protecting the print heads.

As will be understood by those familiar with the art, the invention may be embodied in other specific forms without departing from the spirit or essential characteristics thereof. Likewise, the particular naming and division of the members, features, attributes, and other aspects are not mandatory or significant, and the mechanisms that implement the invention or its features may have different names, divisions and/or formats. Accordingly, the disclosure of the invention is intended to be illustrative, but not limiting, of the scope of the invention, which is set forth in the following Claims.

The invention claimed is:

1. A printing system comprising:

a print carriage having opposing sides, wherein the print carriage is configured to traverse forwards and backwards with respect to a substrate, wherein the print carriage includes a curing station positioned at one of the opposing sides of the print carriage, wherein the curing station includes an ultraviolet light source, a nitrogen applicator, and an oxygen applicator; and a printing block positioned between the curing station and the other of the opposing sides of the print carriage, wherein the printing block includes a plurality of print heads that are configured to deposit ultraviolet curable ink onto the substrate;

wherein the ultraviolet light source is configured to illuminate and cure an application of the deposited ultraviolet curable ink on the substrate;

wherein the nitrogen applicator is configured to emit a blanket of nitrogen gas onto the substrate as the print carriage traverses forwards and backwards with respect to the substrate, wherein the nitrogen applicator is positioned such that the blanket of nitrogen gas is applied after the application of ultraviolet curable ink onto the substrate, before the ultraviolet light source traverses over the applied ultraviolet curable ink, and before the application of ultraviolet curable ink is illuminated with ultraviolet light from the ultraviolet light source, wherein gases proximate to the substrate are supplanted by the blanket of nitrogen gas, and wherein the blanket of nitrogen is delivered onto the substrate in a trailing fashion toward the ultraviolet light source; and wherein the oxygen applicator is configured to emit a blanket of oxygen gas onto the substrate as the print carriage traverses forwards and backwards with respect to the substrate, wherein the oxygen applicator is positioned such that the blanket of oxygen gas is applied before the printing block traverses over the substrate for the application of ultraviolet curable ink onto the substrate, wherein the blanket of nitrogen and other gases proximate to the substrate are supplanted by the blanket of oxygen gas, and wherein the blanket of oxygen gas is delivered onto the substrate in a trailing fashion toward the printing block; and a nitrogen generator configured to generate substantially-pure oxygen and substantially-pure nitrogen, deliver the substantially-pure oxygen to the oxygen applicator, and deliver the substantially-pure nitrogen to the nitrogen applicator; and a controller coupled with the nitrogen generator, wherein the controller is configured to activate or deactivate flow of the substantially-pure nitrogen, and activate or deactivate flow of the substantially-pure oxygen.

2. The printing system of claim 1, wherein the print carriage further comprises:

a second curing station positioned at the other of the opposing sides of the print carriage, wherein the second curing station includes an additional ultraviolet light source;

wherein the ultraviolet light source illuminates and cures an application of ink on the substrate during the forwards traversal of the print carriage, and wherein the additional ultraviolet light source illuminates and cures an application of ink on the substrate during the backwards traversal of the print carriage.

3. The printing system of claim 2, wherein the second curing station includes an additional nitrogen applicator configured to emit an additional blanket of nitrogen gas onto the substrate as the print carriage traverses forwards and backwards with respect to the substrate;

wherein the additional nitrogen applicator is positioned such that the blanket of nitrogen gas is applied after the application of ultraviolet curable ink onto the substrate during the forwards traversal of the print carriage and before the application of ultraviolet curable ink is illuminated with ultraviolet light from the ultraviolet light source during the forwards traversal of the print carriage; and wherein the additional nitrogen applicator is positioned such that the additional blanket of nitrogen gas is applied after the application of ultraviolet curable ink onto the substrate during the backwards traversal of the print carriage and before the application of ultraviolet curable ink is illuminated with ultraviolet light from the additional ultraviolet light source during the backwards traversal of the print carriage.

4. The printing system of claim 3, wherein the second curing station includes an additional oxygen applicator configured to emit an additional blanket of oxygen gas onto the substrate as the print carriage traverses the substrate;

wherein the oxygen applicator is positioned such that the blanket of oxygen gas is applied before a first application of ultraviolet curable ink during the forwards traversal of the print carriage, thereby protecting the plurality of print heads from ultraviolet ink curing onto the plurality of print heads due to stray light in the printing system, and such that the blanket of nitrogen gas from the nitrogen applicator supplants the blanket of oxygen, thereby facilitating curing of the ultraviolet curable ink by the ultraviolet light source during the forwards traversal of the print carriage; and wherein the additional oxygen applicator is positioned such that the additional blanket of oxygen gas is applied before an additional application of ultraviolet curable ink during the backwards traversal of the print carriage, thereby protecting the plurality of print heads from ultraviolet ink curing onto the plurality of print heads due to stray light in the printing system, and such that the additional blanket of nitrogen gas from the additional nitrogen applicator supplants the additional blanket of oxygen, thereby facilitating curing of the ultraviolet curable ink by the additional ultraviolet light source during the backwards traversal of the print carriage.

5. The printing system of claim 4, further comprising:

a processing unit operatively coupled with the oxygen applicator, the additional oxygen applicator, the nitrogen applicator, and the additional nitrogen applicator, wherein the processing unit is configured for selectively activating and deactivating the oxygen applicator, the additional oxygen applicator, the nitrogen applicator, and the additional nitrogen applicator, depending on when their use is required.

6. The printing system of claim 1, further comprising:

a second printing block positioned between the printing block and the other of the opposing sides of the print carriage, wherein the second printing block an additional plurality of print heads; and an intermediary oxygen applicator;

wherein the second printing block is separated from the printing block by the intermediary oxygen applicator, wherein the intermediary oxygen applicator is configured to supply a blanket gas beneath the printing block during the forwards traversal of the print carriage and to supply a blanket gas beneath the additional group of print heads during the backwards traversal of the print carriage.

7. The printing system of claim 1, wherein the ultraviolet light source includes a light emitting diode.

8. A method of printing comprising:

traversing a print carriage backwards and forwards with respect to a substrate, wherein the print carriage includes a printing block including a group of print heads;

a first curing station located adjacent to a first side of the printing block, wherein the first curing station includes a first ultraviolet source, a first nitrogen applicator, and a first oxygen applicator; and a second curing station located adjacent to a second side of the printing block opposite to the first curing station, wherein the second curing station includes an additional ultraviolet source, an additional nitrogen applicator, and an additional oxygen applicator;

emitting a blanket of oxygen gas from the first oxygen applicator onto the substrate during a forwards traversal of the print carriage before the printing block traverses forwards over the substrate, thereby creating an oxygen rich environment, wherein the blanket of oxygen gas is delivered onto the substrate in a trailing fashion toward the printing block;

applying an application of ultraviolet curable ink from the group of print heads onto the substrate in the oxygen rich environment;

emitting a blanket of nitrogen gas from the first nitrogen applicator onto the substrate after the application of ultraviolet curable ink during the forwards traversal of the print carriage before the first ultraviolet light source traverses forwards over the applied ultraviolet curable ink, thereby supplanting the blanket of oxygen gas and creating a nitrogen rich environment, wherein the blanket of nitrogen is delivered onto the substrate in a trailing fashion toward the first ultraviolet light source;

exposing the application of ultraviolet curable ink to light in the nitrogen rich environment from the first ultraviolet light source during the forwards traversal of the print carriage, thereby curing the ultraviolet curable ink;

emitting an additional blanket of oxygen gas from the additional oxygen applicator that is directed onto the substrate during a backwards traversal of the print carriage before the printing block traverses backwards over the substrate, thereby creating an oxygen rich environment, wherein the additional blanket of oxygen gas is delivered onto the substrate in a trailing fashion toward the group of print heads;

applying an application of ultraviolet curable ink from the group of print heads onto the substrate in the oxygen rich environment;

emitting an additional blanket of nitrogen gas from the additional nitrogen applicator onto the substrate after the application of ultraviolet curable ink during the backwards traversal of the print carriage before the additional ultraviolet light source traverses backwards over the applied ultraviolet curable ink, thereby supplanting the additional blanket of oxygen gas and creating a nitrogen rich environment, wherein the blanket of nitrogen gas is delivered onto the substrate in a trailing fashion toward the additional ultraviolet light source;

generating substantially-pure oxygen and substantially-pure nitrogen using a membrane-based nitrogen generator operatively coupled with the first nitrogen applicator, the additional nitrogen applicator, the first oxygen applicator, and the additional oxygen applicator, wherein the membrane-based nitrogen generator includes a controller, wherein the controller activates or deactivates flow of the substantially-pure nitrogen, and wherein the controller activates or deactivates flow of the substantially-pure oxygen; and exposing the application of ultraviolet curable ink to light in the nitrogen rich environment from the additional ultraviolet light source during the backwards traversal of the print carriage, thereby curing the ultraviolet curable ink.

9. The method of claim 8, wherein the print carriage further comprises:

a second printing block including an additional group of print heads separated from the printing block by a further oxygen applicator, the method further comprising:

emitting a blanket of oxygen gas from the further oxygen applicator onto the substrate during both of the forwards traversal and the backwards traversal of the print carriage, thereby enhancing the oxygen rich environment.

10. The method of claim 8, further comprising:

selectively activating and deactivating, by a processor, the oxygen applicator, the additional oxygen applicator, the nitrogen applicator, and the additional nitrogen applicator, depending on when their use is required.

* * * * *